US006966638B2

(12) United States Patent
Ota et al.

(10) Patent No.: US 6,966,638 B2
(45) Date of Patent: Nov. 22, 2005

(54) INK CARTRIDGE AND ASSEMBLING METHOD OF ATMOSPHERIC OPEN VALVE IN INK CARTRIDGE

(75) Inventors: Mutsuhiko Ota, Nagano (JP); Yukiharu Suda, Nagano (JP); Hisashi Koike, Nagano (JP); Satoshi Shinada, Nagano (JP); Michinari Tsukahara, Nagano (JP); Hisashi Miyazawa, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/147,325

(22) Filed: May 17, 2002

(65) Prior Publication Data

US 2003/0007043 A1 Jan. 9, 2003

(30) Foreign Application Priority Data

| | | |
|---|---|---|
| May 17, 2001 | (JP) | P2001-147418 |
| Jul. 19, 2001 | (JP) | P2001-220340 |
| Jul. 19, 2001 | (JP) | P2001-220354 |
| Aug. 30, 2001 | (JP) | P2001-262038 |
| Aug. 31, 2001 | (JP) | P2001-264179 |

(51) Int. Cl.[7] ..... B41J 2/175
(52) U.S. Cl. ..... 347/86
(58) Field of Search ..... 347/84, 85, 86, 347/87

(56) References Cited

U.S. PATENT DOCUMENTS

| | | | | |
|---|---|---|---|---|
| 5,040,002 A * | 8/1991 | Pollacek et al. | ..... | 347/87 |
| 5,801,737 A * | 9/1998 | Sato et al. | ..... | 347/86 |
| 6,390,611 B1 * | 5/2002 | Kobayashi et al. | ..... | 347/84 |
| 6,536,885 B2 * | 3/2003 | Kuribayashi et al. | ..... | 347/85 |
| 6,585,358 B2 * | 7/2003 | Usui et al. | ..... | 347/85 |

FOREIGN PATENT DOCUMENTS

| | | | | |
|---|---|---|---|---|
| EP | 0 709 207 A2 | | 5/1996 | |
| EP | 1 016 533 | | 7/2000 | |
| EP | 1 055 520 A1 | | 11/2000 | |
| JP | 6-64181 | | 3/1994 | |
| JP | 11-129492 | * | 5/1999 | ..... B41J 2/175 |
| WO | WO00/03877 | | 1/2000 | |

OTHER PUBLICATIONS

Japanese Abstract No. 03016738, dated Jan. 24, 1991.
Japanese Abstract No. 04187448, dated Jul. 6, 1992.

* cited by examiner

*Primary Examiner*—Anh T. N. Vo
(74) *Attorney, Agent, or Firm*—Sughrue Mion, PLLC

(57) ABSTRACT

An ink cartridge has a container main body [2] having a through hole [60] for making an ink storage chamber and an atmospheric open chamber [501] to communicate with each other, and an atmospheric open valve [601] having a valve body [65] capable of opening and closing the through hole [60] of the container main body [2] and an elastic member [62] capable of pressing the valve body [65] in a closed direction. In an assembling structure of the atmospheric open valve [601] in the atmospheric open chamber [501], the valve body [65] is placed at such a position blocking the opening of the through hole [60], the elastic member [62] is positioned in the atmospheric open chamber [501] as a bend piece shaped like < is expanded, and the elastic member [62] in the positioned state presses at one end part the valve body [65] in the closed direction and is fixed at an opposite end part to the inside of the atmospheric open chamber [501].

82 Claims, 10 Drawing Sheets

INK CARTRIDGE AND ASSEMBLING METHOD OF ATMOSPHERIC OPEN VALVE IN INK CARTRIDGE

BACKGROUND OF THE INVENTION

This invention relates to an ink cartridge for supplying ink to a head of a record apparatus, and an assembling method of an atmospheric open valve in the ink cartridge.

An ink jet record apparatus generally comprises a record head mounted on a carriage and moving in the width direction of record paper, and paper feed means for moving the record paper relatively in a direction orthogonal to the move direction of the record head.

Such an ink jet record apparatus prints on record paper by ejecting ink droplets from a record head based on print data.

A record head capable of ejecting black ink, yellow ink, cyan ink, and magenta ink, for example, is mounted on a carriage and in addition to text print in black ink, full-color print is made possible by changing the ink ejection percentage.

Thus, ink cartridges for supplying black ink, yellow ink, cyan ink, and magenta ink to the record head are placed in the main unit of the apparatus.

In the ordinary ink jet record apparatus, the ink cartridges for supplying black ink, yellow ink, cyan ink, and magenta ink are mounted on a carriage and are moved together with the carriage.

In the recent record apparatus, the carriage has been moved at high speed for the purpose of increasing the record speed.

In such a record apparatus, pressure fluctuation occurs in internal ink as an ink supply tube is extended and bent with acceleration and deceleration of the carriage, making unstable ejecting of ink droplets from the record head.

Thus, such an ink cartridge is proposed, that comprises a lower ink storage chamber (ink tank chamber) opened to the atmosphere side, an upper ink storage chamber (ink end chamber) for head connection, connected via an ink flow passage to the lower ink storage chamber, and a differential pressure regulating valve placed at midpoint in a passage connecting the upper ink storage chamber and a head supply port.

According to the ink cartridge, a negative pressure is generated on the head side by negative pressure generation means and the differential pressure regulating valve is opened accordingly for supplying ink to the record head, so that the adverse effect on ink produced by pressure fluctuation mentioned above is lessened and ink can be supplied to the record head at the optimum water head difference.

Such an ink cartridge comprises an atmospheric open valve constructed by: a valve body capable of opening and closing an atmospheric communication hole to make an ink storage chamber and an atmospheric open chamber communicate with each other; and an elastic member capable of pressing the valve body in a closed direction.

As the ink cartridge is mounted to a record apparatus, the atmospheric open valve is opened, whereby the ink storage chamber is made to communicate with the atmospheric side, and on the other hand, as the ink cartridge is detached, the atmospheric open valves is closed, whereby communication between the ink storage chamber and the atmospheric side is shut off.

However, in the assembling structure of the atmospheric open valve in this kind of ink cartridge, the valve body is urged simply by fixing one end part of the elastic member to the inside of the atmospheric open chamber. Therefore, in designing the ink cartridge, the fixing position of the elastic member, etc., needs to be sufficiently considered for determining the urging force of the elastic member. Consequently, the number of design items increases, and design of the ink cartridge is complicated; this is a problem.

It is therefore an object of the invention to provide an ink cartridge and an assembling structure and method of an atmospheric open valve in the ink cartridge, which make it possible to decrease the number of design items and therefore simplify the ink cartridge design.

SUMMARY OF THE INVENTION

To the end, according to the invention, there is provided an ink cartridge comprising a cartridge main body having an atmospheric communication hole for communicating an ink storage chamber and an atmospheric open chamber with each other; and an atmospheric open valve having a valve body capable of opening and closing the atmospheric communication hole of the cartridge main body, and an elastic member made of a bent piece, preferably shaped like "<", and capable of pressing the valve body in a closed direction, wherein the elastic member presses at one end part the valve body in the closed direction and is fixed at an opposite end part to the inside of the atmospheric open chamber.

According to the invention, there is provided an ink cartridge comprising a cartridge main body having an atmospheric communication hole for communicating an ink storage chamber and an atmospheric open chamber with each other; and an atmospheric open valve having a valve body capable of opening and closing the atmospheric communication hole of the cartridge main body, and an elastic member made of a bent piece, preferably shaped like "<", and capable of pressing the valve body in a closed direction, wherein the valve body is placed at such a position as to close an opening of the atmospheric communication hole, the elastic member is developed and positioned in the atmospheric open chamber, and in the positioned state, the elastic member presses at one end part the valve body in the closed direction and is fixed at an opposite end part to the inside of the atmospheric open chamber.

Because of such a structure, at the time when the atmospheric open valve is assembled, the force urging the valve body by the elastic member is determined.

Therefore, the need for considering the fixing position of the elastic member, etc., at the design time as in the related art is eliminated, so that the number of design items can be decreased and the ink cartridge design can be simplified.

It is desirable that the chamber wall of the atmospheric open chamber is formed with two convex parts projecting in a direction parallel to the axial direction of the atmospheric communication hole, that the convex parts are inserted into the elastic member, that the movement of the one end part of the elastic member is regulated by the insertion end part close to the valve body, and that the insertion end part distant from the valve body is crushed to fix the opposite end part of the elastic member.

Since the ink cartridge is thus configured, the atmospheric open valve is assembled by closing the atmospheric communication hole by the valve body and then inserting the two convex parts into the elastic member, and crushing the insertion end part distant from the valve body for fixing the elastic member.

It is desirable that the crush position of the insertion end part is such a position lessening the spring effective length of the elastic member.

Since the ink cartridge is thus configured, the spring force of the elastic member is enlarged and the force sealing the atmospheric communication hole by the valve body is increased.

On the other hand, according to the invention, there is provided, the assembling method applicable to an ink cartridge comprising a cartridge main body having an atmospheric communication hole for communicating an ink storage chamber and an atmospheric open chamber with each other; and an atmospheric open valve having a valve body capable of opening and closing the atmospheric communication hole of the cartridge main body and an elastic member made of a bent piece, preferably shaped like "<", and capable of pressing the valve body in a closed direction. The assembling method is an assembling method of the atmospheric open valve in the atmospheric open chamber, and comprises the steps of, to assemble the atmospheric open valve, placing the valve body at such a position as to close an opening of the atmospheric communication hole; developing the elastic member with the valve body pressed in the closed direction, thereby positioning the elastic member in the atmospheric open chamber; and then fixing an end part of the elastic member, opposite from the pressing end part of the elastic member, to the inside of the atmospheric open chamber.

According to such a method, when the atmospheric open valve is assembled, the force urging the valve body by the elastic member is determined.

Therefore, the need for considering the fixing position of the elastic member, etc., at the design time as in the related art is eliminated, so that the number of design items can be decreased and an ink cartridge easily designed can be provided.

It is desirable that to fix the elastic member, a convex part formed on a chamber wall of the atmospheric open chamber and preliminarily inserted into the elastic member is partially crushed under pressure and at room temperature.

According to such a method, the crush force is given to the convex part, and therefore the elastic member can be fixed to the inside of the atmospheric open chamber without deformation of the elastic member.

Further, it is desirable that the crest of the bent part or the proximity thereof is depressed to develop the elastic member.

According to such a method, the seal force for pressing the atmospheric open valve is increased.

Here, it is desirable that while the depressing force of the elastic member is measured, the crest of the bent part or the proximity thereof is depressed and/or that the crest of the bent part or the proximity thereof is depressed until the elastic member is made horizontal.

The present disclosure relates to the subject matter contained in Japanese patent application Nos. 2001-147418 (filed on May 17, 2001), 2001-262038 (filed on Aug. 30, 2001), 2001-264179 (filed on Aug. 31, 2001), 2001-220340 (filed on Jul. 19, 2001), and 2001-220354 (filed on Jul. 19, 2001), which are expressly incorporated herein by reference in their entireties.

DESCRIPTION OF THE PREFERRED EMBODIMENT

Referring now to the accompanying drawings, there are shown preferred embodiments of an ink cartridge and assembling structure and method of an atmospheric open valve in the ink cartridge incorporating the invention.

Figure 1:
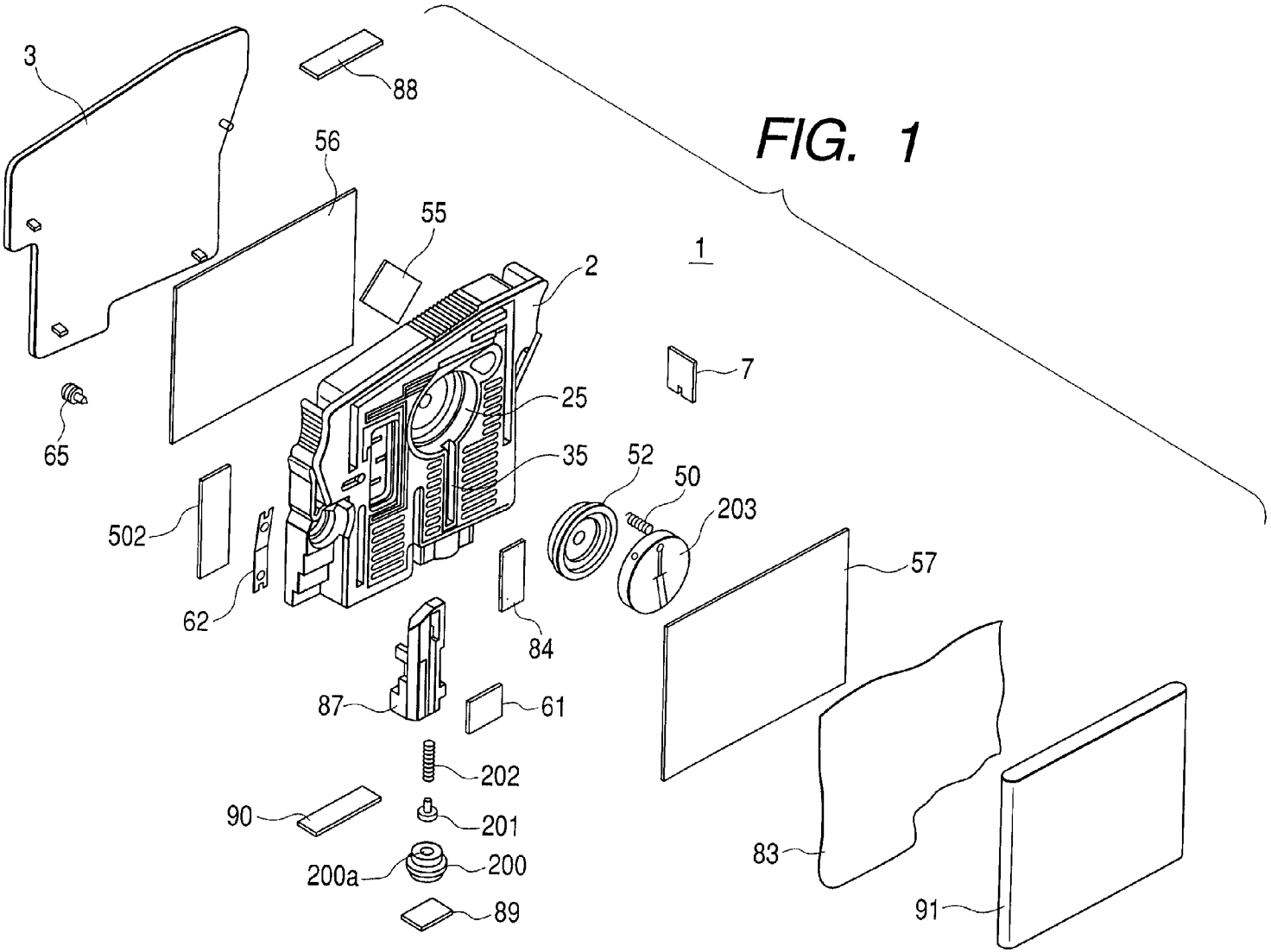
FIG. 1 is an exploded perspective view to show the whole of the ink cartridge according to an embodiment of the invention.
Figure 2A:
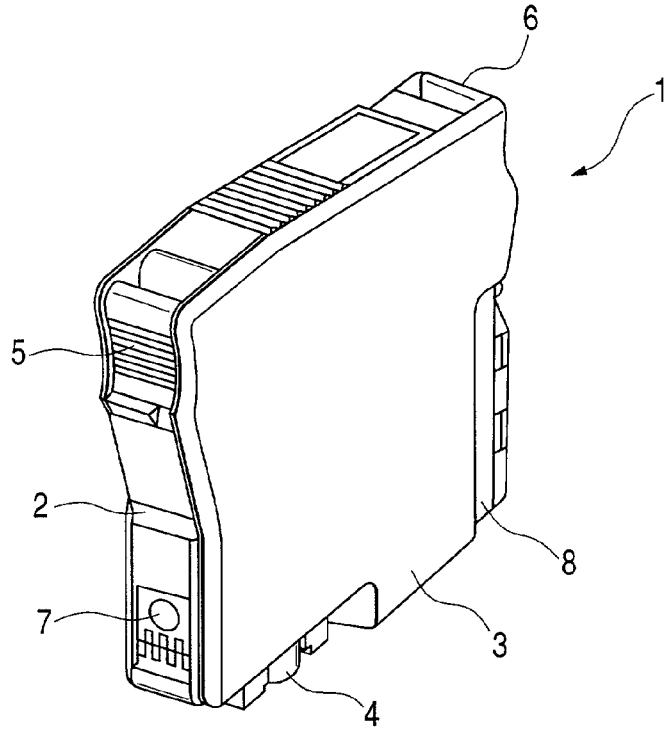
FIGS. 2(*a*) and 2(*b*) are perspective views to show the appearance of the ink cartridge according to the embodiment of the invention.
Figure 2B:
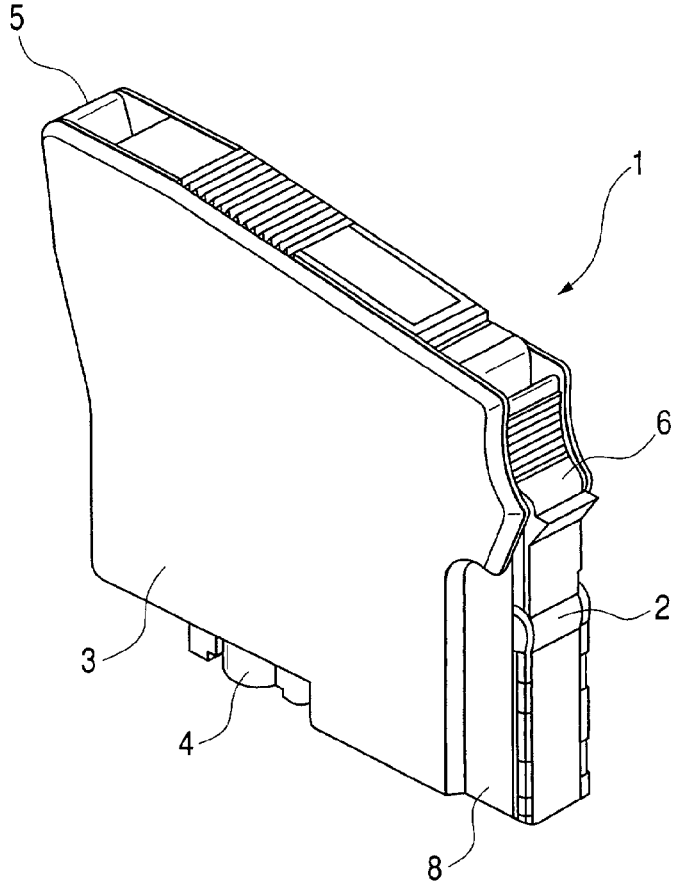
Figure 3:
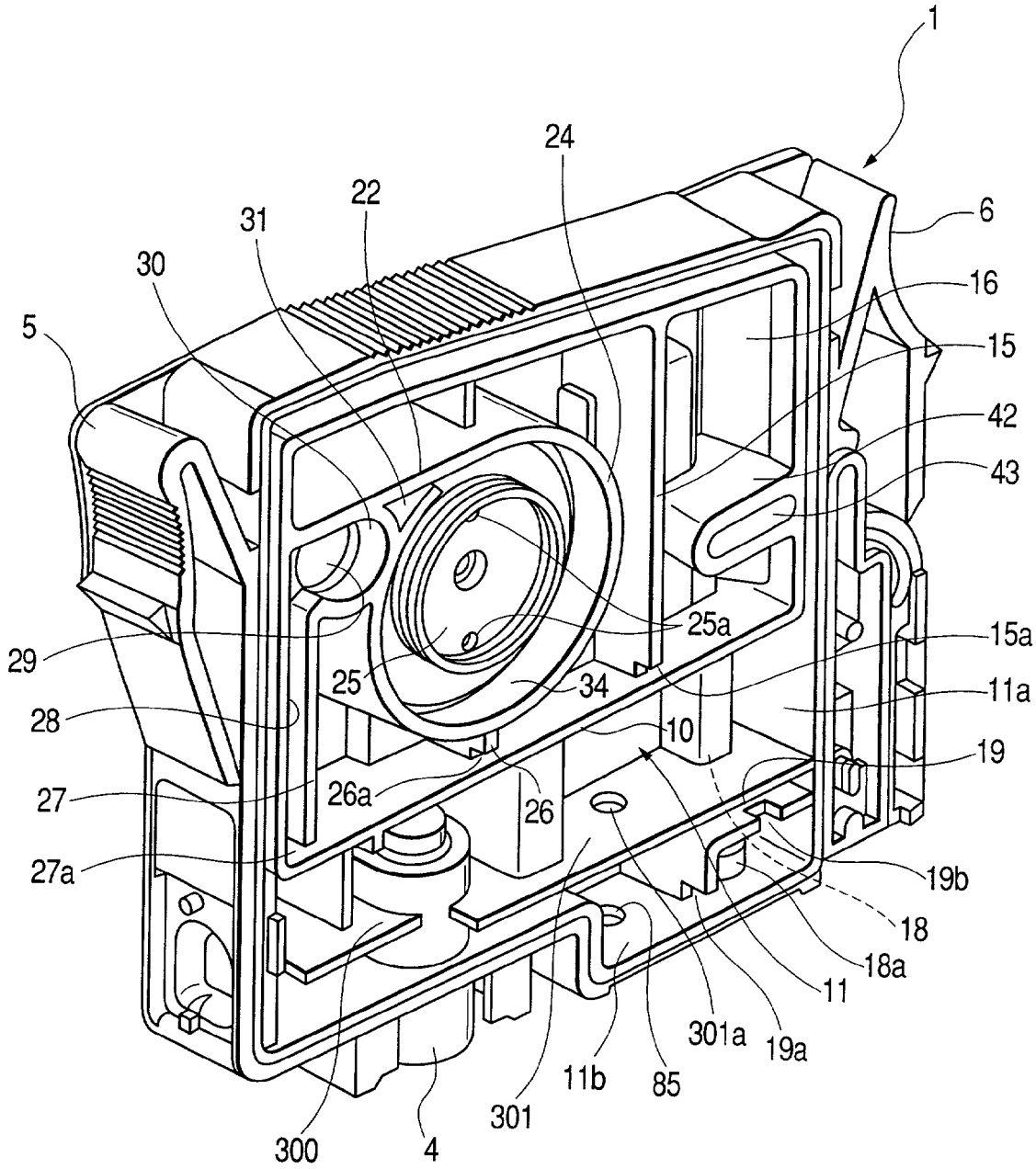
FIG. 3 is a perspective view showing the internal structure of the ink cartridge according to the embodiment of the invention as viewed from upward in a slanting direction.
Figure 4:
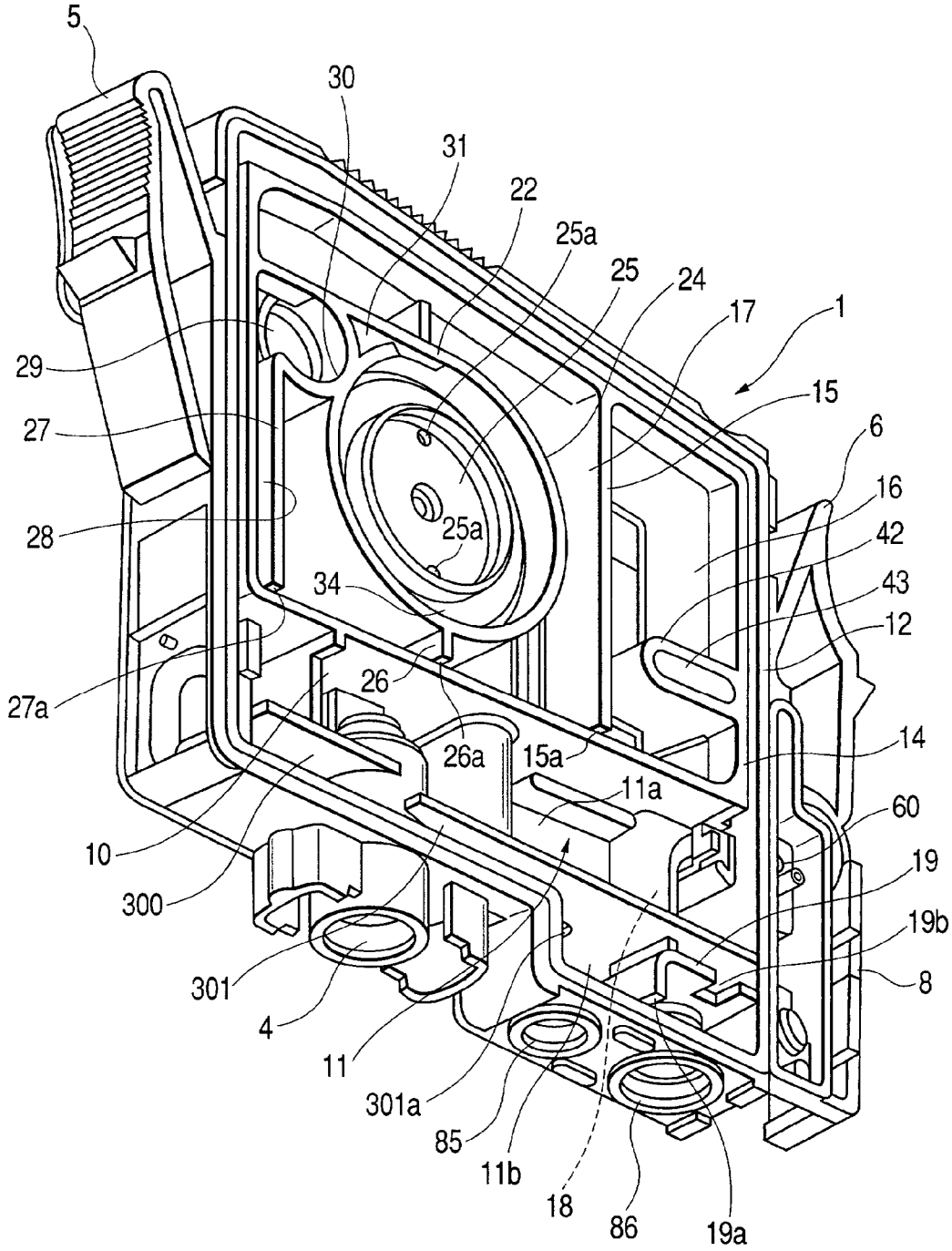
FIG. 4 is a perspective view showing the internal structure of the ink cartridge according to the embodiment of the invention as viewed from downward in a slanting direction.
Figure 5:
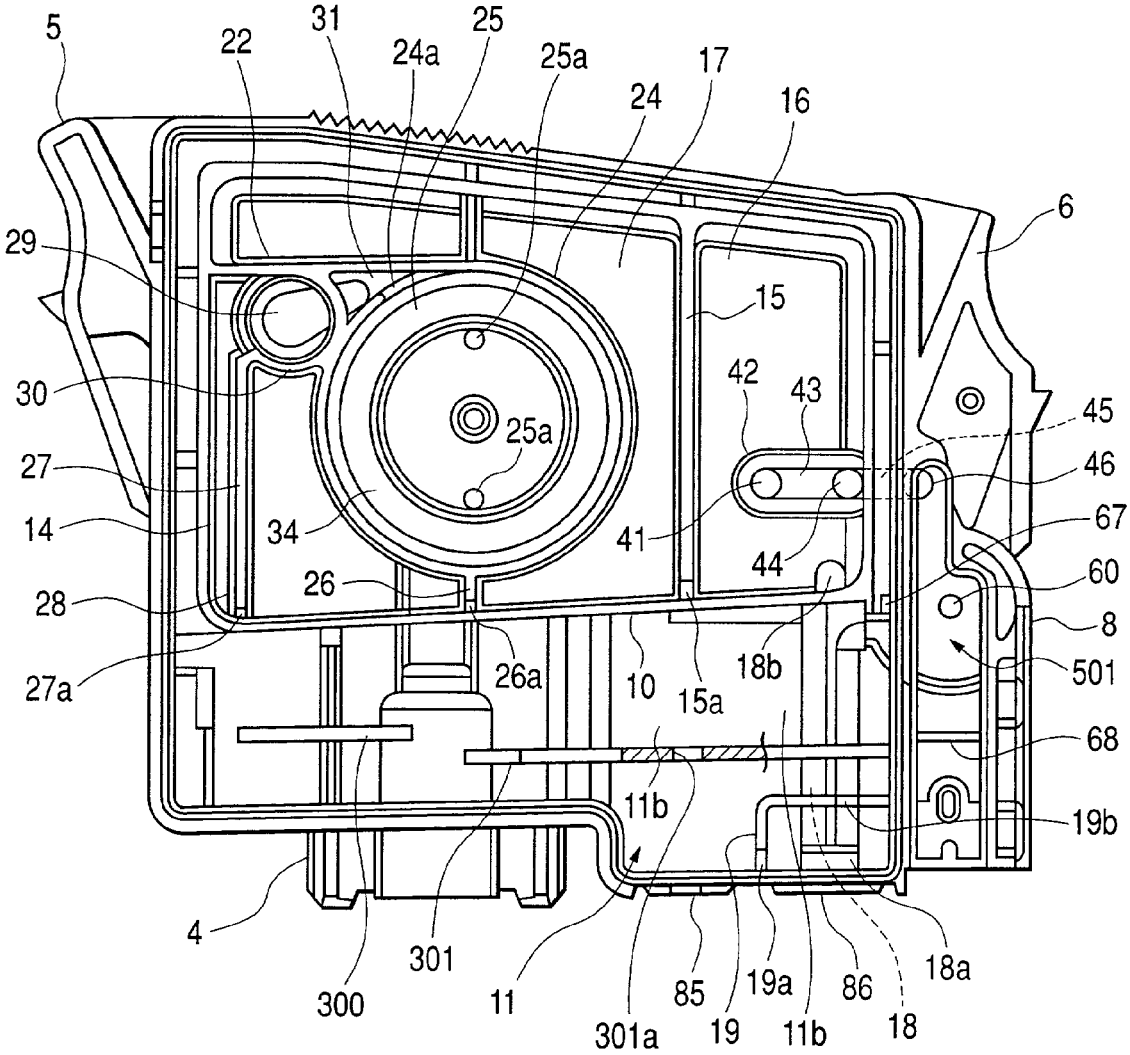
FIG. 5 is a front view to show the internal structure of the ink cartridge according to the embodiment of the invention.
Figure 6:
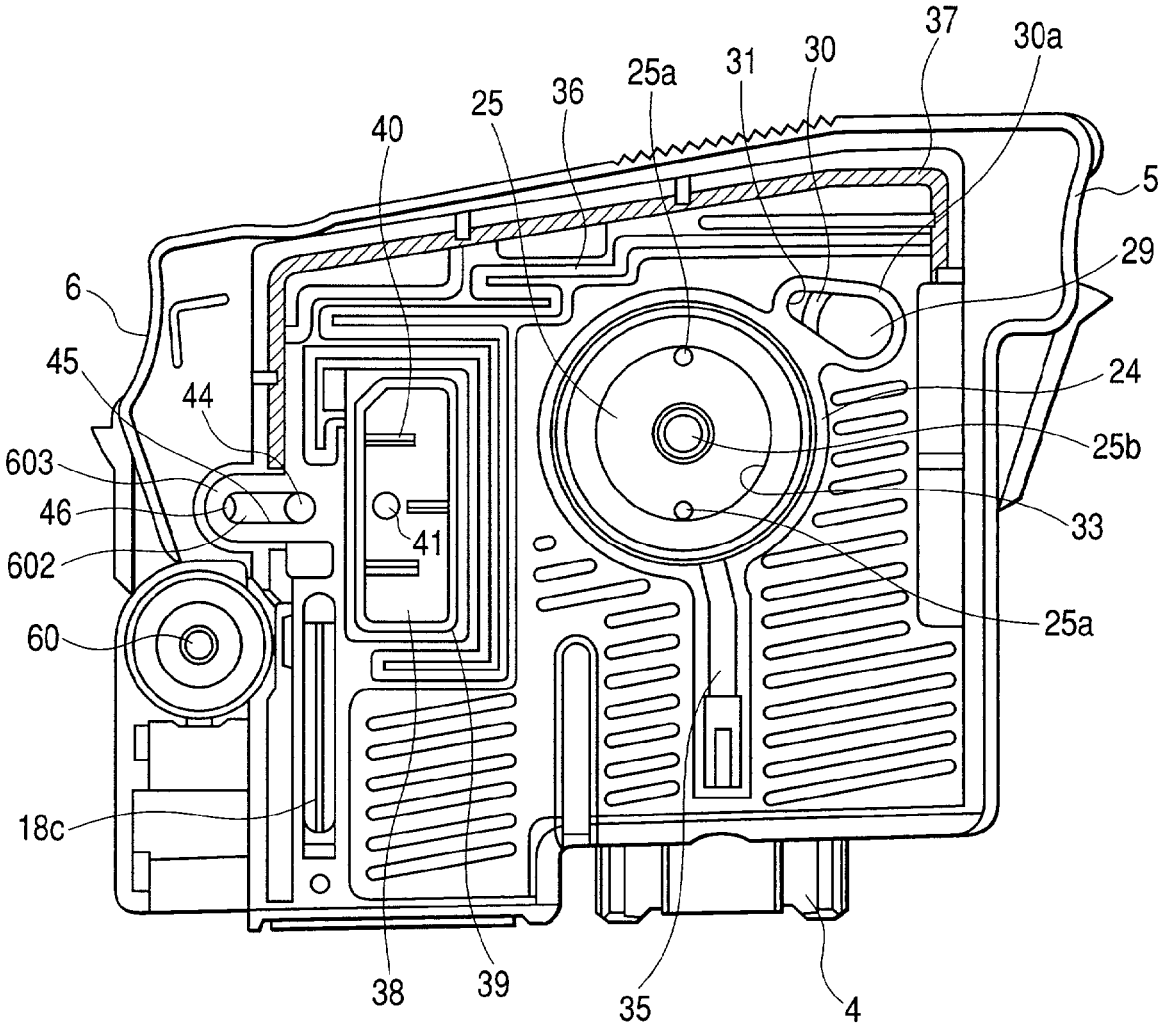
FIG. 6 is a rear view to show the internal structure of the ink cartridge according to the embodiment of the invention.
Figure 7:
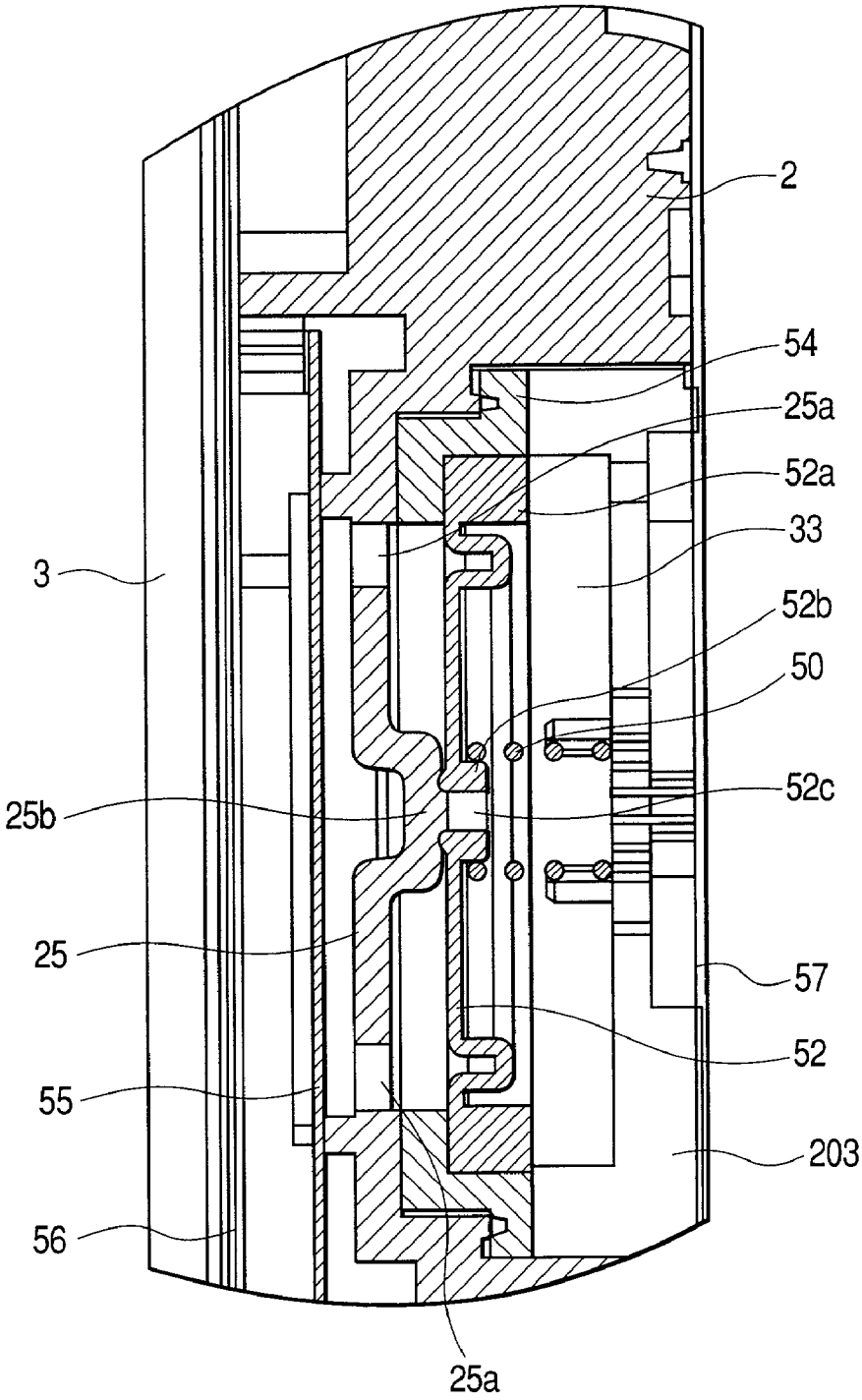
FIG. 7 is an enlarged sectional view to show a negative pressure generation system storage chamber of the ink cartridge according to the embodiment of the invention.
Figure 8:
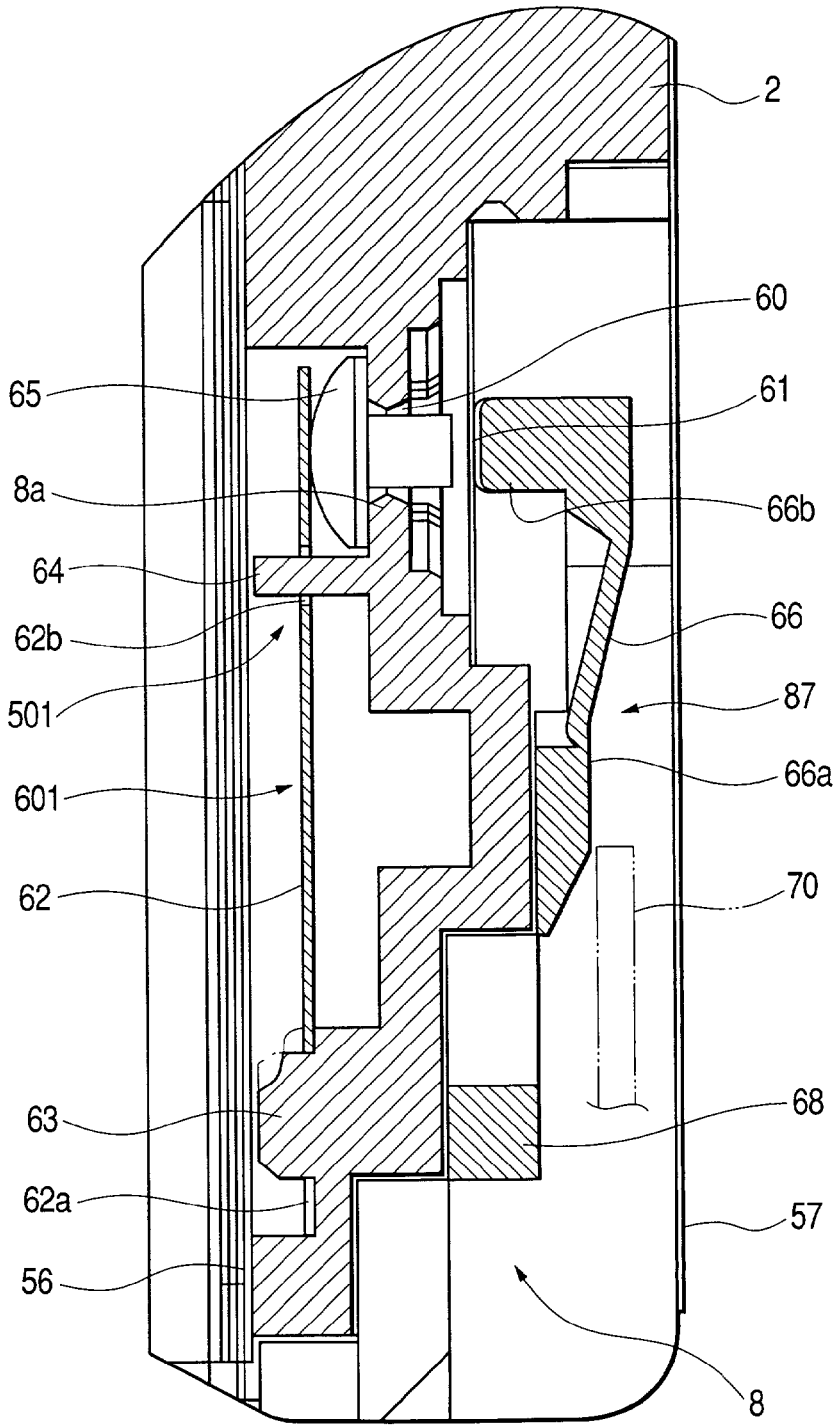
FIG. 8 is an enlarged sectional view to show a valve storage chamber of the ink cartridge according to the embodiment of the invention.
Figure 9:
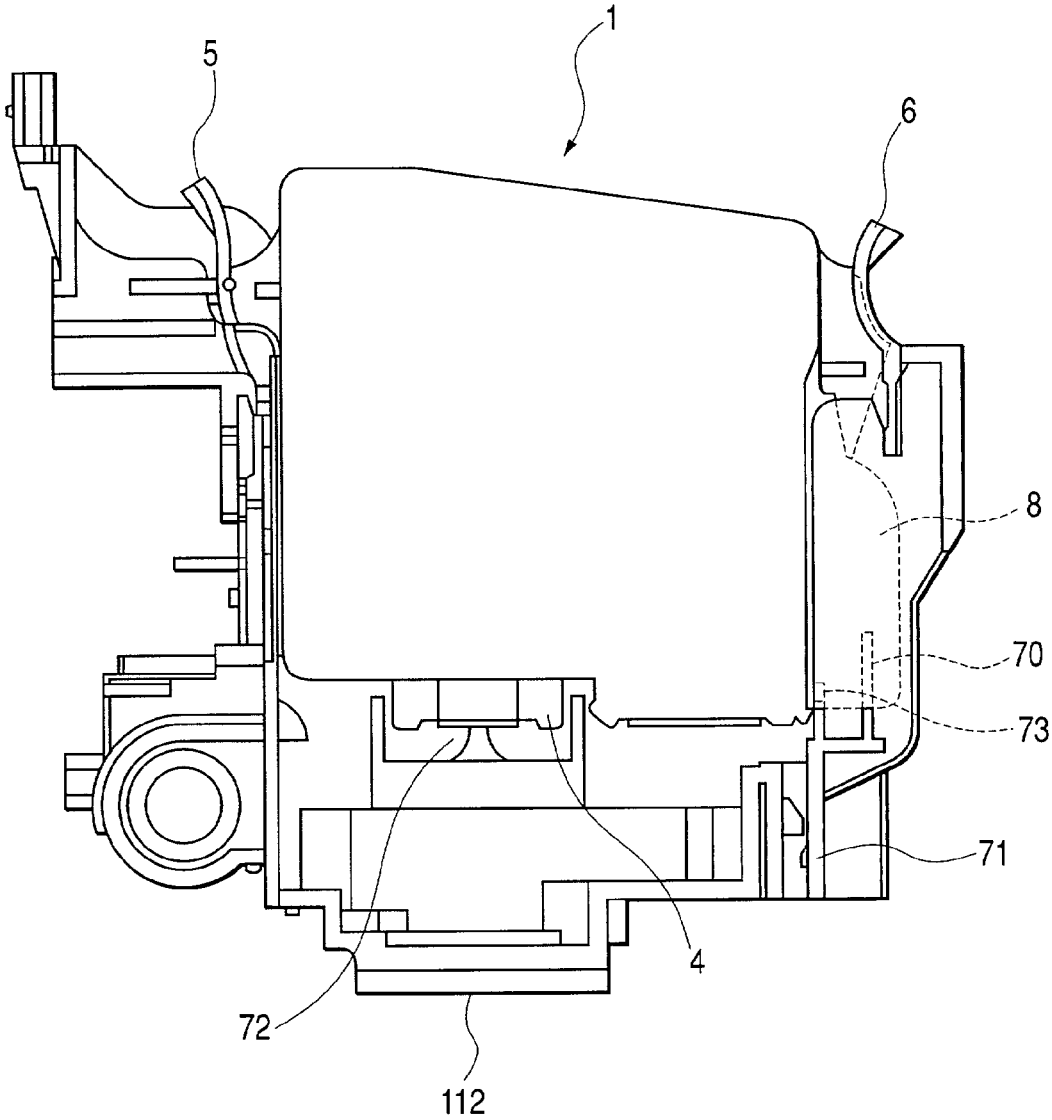
FIG. 9 is a front view to show the connection state of the ink cartridge according to the embodiment of the invention to a cartridge holder.
Figure 10A:
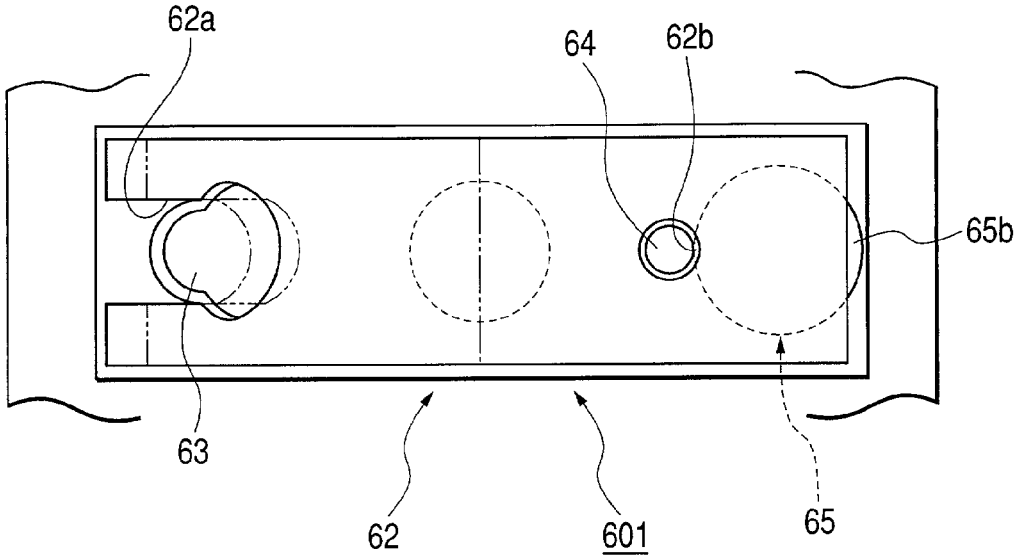
FIGS. 10(*a*) and 10(*b*) are a plan view and a sectional view to describe the assembling structure (method) of an atmospheric open valve in the ink cartridge according to the embodiment of the invention.
Figure 10B:
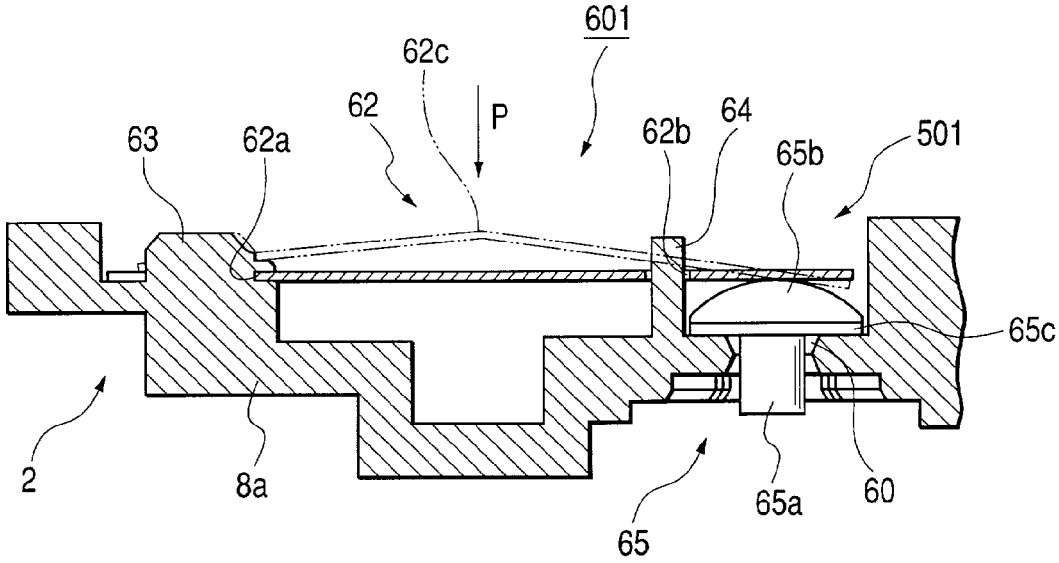

To begin with, the ink cartridge and the assembling structure of the atmospheric open valve will be discussed with reference to FIGS. 1 to 10. FIG. 1 is an exploded perspective view to show the whole of the ink cartridge according to the embodiment of the invention. FIGS. 2(*a*) and 2(*b*) are perspective views to show the appearance of the ink cartridge according to the embodiment of the invention. FIGS. 3 and 4 are perspective views showing the internal structure of the ink cartridge according to the embodiment of the invention as viewed from upward and downward in a slanting direction. FIGS. 5 and 6 are a front view and a rear view to show the internal structure of the ink cartridge according to the embodiment of the invention. FIGS. 7 and 8 are enlarged sectional views to show a negative pressure generation system storage chamber and a valve storage chamber (assembling structure of atmospheric open valve) of the ink cartridge according to the embodiment of the invention. FIG. 9 is a front view to show the connection state of the ink cartridge according to the embodiment of the invention to a cartridge holder. FIGS. 10(*a*) and 10(*b*) are a plan view and a sectional view to describe the assembling structure of the atmospheric open valve in the ink cartridge according to the embodiment of the invention.

An ink cartridge 1 shown in FIGS. 2(*a*) and 2(*b*) has a container main body (lower case) 2 almost rectangular in a plane view, and opened to one side, and a lid body (upper case) 3 for sealing the opening of the container main body 2. The interior of the ink cartridge 1 is generally constructed to have an ink flow passage system and an air flow passage system (both described later).

Formed in the lower portion of the container main body 2 are an ink supply port 4 that can be connected to an ink supply needle 72 of a record head 112 (both are shown in FIG. 9), and a first opening (open hole) 85 and a second opening 86 (both are shown in FIGS. 4 and 5) placed side by side adjacent to the ink supply port 4. The ink supply port 4 is made to communicate with an ink end chamber (differential pressure regulating valve storage chamber) described later, and the first opening 85 is made to communicate with a first ink storage chamber (ink tank chamber) 11.

A substantially cylindrical seal member 200 made of rubber, etc., is placed in the ink supply port 4, as shown in FIG. 1. A through hole 200*a* axially opened is made at the center of the seal member 200. A spring bracket (valve body) 201 for opening and closing the through hole 200*a* as the ink supply needle 72 is inserted and removed is disposed in the ink supply port 4, and further a helical compression spring 202 for urging the spring bracket 201 to the seal member 200 is placed.

Retention members 5 and 6 that can be attached to and detached from a cartridge holder are provided integrally on the upper sides of the container main body 2. A circuit board (IC board) 7 is disposed below one retention member 5 as shown in FIG. 2(*a*), and a valve storage chamber 8 is disposed below the other retention member 6 as shown in FIGS. 2(*a*) and 2(*b*).

The circuit board 7 has a storage device retaining information data concerning ink, for example, color type, pigment/dye based ink type, ink remaining amount, serial number, expiration date, applied model, and the like so that the data can be written.

The valve storage chamber 8 has an internal space opened to the cartridge insertion side (lower side) as shown in FIG. 8, and an identification piece(s) 73 and a valve operation rod 70 (shown in FIG. 9) on the record apparatus matching with the ink cartridge 1 advance and retreat in the internal space. An operation arm 66 of an identification block 87, which is rotated as the valve operation rod 70 advances and retreats, is housed in the upper part of the internal space. An identification convex part(s) 68 for determining whether or not the ink cartridge matches with a given record apparatus is formed in the lower part of the internal space. The identification convex part 68 is placed at a position for making possible a determination by the valve operation rod 70 (the identification piece 73) of a cartridge holder 71 (shown in FIG. 9) before the ink supply needle 72 (shown in FIG. 9) on the record apparatus is made to communicate with the ink supply port 4 (before an atmospheric open valve described later is opened).

A through hole 60 as an atmospheric communication hole opened and closed by the opening and closing operation of an atmospheric open valve 601 is made in a chamber wall 8*a* of the valve storage chamber 8 (atmospheric open chamber 501), as shown in FIG. 8. Convex parts 63 and 64 projecting in a direction parallel to the axial direction of the through hole 60 are formed integrally on the chamber wall 8*a*. The operation arm 66 is placed on one opening side of the through hole 60, and the atmospheric open valve 601 is placed on the other opening side of the through hole 60. The operation arm 66 has an operation part 66*b* for pressing a pressurization film (elastically deformable film) 61, and is placed projecting in an upward slanting direction into the path of the valve operation rod 70 and is fixed to the container main body 2 through a rotation supporting point 66*a*.

The pressurization film 61 is attached to the chamber wall 8*a* so as to block the through hole 60, and the whole of the pressurization film 61 is formed of an elastic seal member of rubber, etc. The internal space formed between the pressurization film 61 and the opening peripheral margin of the through hole 60 is opened to a through hole 67 communicating with the first ink storage chamber (ink tank chamber) 11 (both are shown in FIG. 5).

The atmospheric open valve 601 has a valve body 65 capable of opening and closing the through hole 60, and an elastic member 62 capable of pressing the valve body 65 in a closed direction, as shown in FIGS. 8 and 10(*a*) and 10(*b*). The valve body 65 has a cylinder part 65*a* inserted into the through hole 60, and a valve part 65*b* capable of being pressed into contact with the opening peripheral margin of the through hole 60 in a closed valve state. The whole of the valve body 65 is formed of an elastic material, such as an elastomer, etc. The elastic member 62 has, at its end portions, a notch 62*a* and a through hole 62*b* into which the projections (convex parts) 63 and 64 are respectively inserted, and is formed of a plate spring that can be positioned in the atmospheric open chamber 501 as a bend piece (bend part 62*c*) shaped like "<", made of stainless steel, etc., for example, is developed. The movement of the end part of the elastic member 62 close to the valve body 65 is regulated by the projection 64, so that the elastic member 62 presses and urges the valve body 65 when the elastic member 62 is positioned in place. The end part distant from the valve body 65 is fixed by crushing (deforming) the insertion end part of the projection 63 (a part of the projection 63). The crushed position on the projection 63 is so selected as to reduce the spring effective length of the elastic member 62 in order to enlarge the spring force (press urging force) of the elastic member 62 and enhance the force sealing the through hole 60 by the valve body 65.

In FIG. 1, numeral 88 denotes an identification label put on an upper face part of the container main body 2 corresponding to the block 87, numeral 89 denotes a film for sealing the ink supply port 4 (through hole 200*a*), and numeral 90 denotes a film for sealing the first opening 85 and the second opening 86. Numeral 91 denotes a vacuum pack for wrapping the ink cartridge 1 already filled with ink.

Next, the ink flow passage system and the air flow passage system in the container main body 2 will be discussed with reference to FIGS. 1 to 9.

[Ink Flow Passage System]

The ink cartridge 1 is formed with an internal space by joining the lid body 3 to the front of the container main body 2 through inner films (air shield films) 56 and 502 and joining a protective label 83 to the rear of the container main body 2 through an outer film (air shield film) 57, as shown in FIG. 1. The internal space is divided into upper and lower parts by a partition wall 10 extending slightly downward toward the ink supply port side opposed to the record head 112 (shown in FIG. 9), as shown in FIGS. 3 to 5. The lower area of the internal space provides the first ink storage chamber 11 opened to the atmosphere in the connection state to the record head 112.

Two intermediate walls 300 and 301 different in height position are disposed in the first ink storage chamber 11. One intermediate wall 300 is placed with a predetermined spacing from one side surface part of the first ink storage chamber 11. The other intermediate wall 301 is opposed to the bottom part of the first ink storage chamber 11 and is placed on the ink supply port side of the intermediate wall 300. The intermediate wall 301 partitions the first ink storage chamber 11 into two space parts 11*a* and 11*b* placed side by side in the ink injection direction (up and down). The intermediate wall 301 is formed with a through part 301*a* having the same axis as the axis of the first opening 85.

On the other hand, the upper area of the internal space is defined by a frame 14 with the partition wall 10 as a bottom part. The internal space of the frame 14 forms (a part of) the ink end chamber connected to the record head 112, and the front side of the ink end chamber is divided into left and right parts by a vertical wall 15 having a communication port 15*a*. One of the areas into which the internal space is divided provides a second ink storage chamber 16, and the other area provides a third ink storage chamber 17.

A communication flow passage 18 communicating with the first ink storage chamber 11 is connected to the second ink storage chamber 16. The communication flow passage 18 has communication ports 18*a* and 18*b* at lower and upper positions. The communication flow passage 18 is formed by a recess part 18*c* (shown in FIG. 6) opened to the rear of the container main body 2 and extending in the up and down direction and an air shield film (outer film 57) for blocking and sealing the opening of the recess part 18*c*. A partition wall 19 having two lower and upper communication ports 19*a* and 19*b* communicating with the inside of the first ink storage chamber 11 is provided upstream from the communication flow passage 18. One communication port 19*a* is placed at a position opened to the lower area in the first ink storage chamber 11. The other communication port 19*b* is placed at a position opened to the upper area in the first ink storage chamber 11.

On the other hand, the third ink storage chamber 17 is formed with a differential pressure regulating valve storage chamber 33 (shown in FIG. 6) for storing a differential pressure regulating valve 52 (membrane valve) shown in FIG. 7 and a filter chamber 34 (shown in FIG. 5) for storing a filter 55 (nonwoven fabric filter) shown in FIG. 7 by a laterally elongating partition wall 22 and an annular partition wall 24. The partition wall 25 is formed with through holes 25*a* for introducing ink passed through the filter 55 into the differential pressure regulating valve storage chamber 33 from the filter chamber 34.

The partition wall 24 is formed at a lower part with a partition wall 26 having a communication port 26*a* between the partition wall 24 and the partition wall 10, and is formed on a side with a partition wall 27 having a communication port 27*a* between the partition wall 24 and the frame 14. A communication passage 28 communicating with the communication port 27*a* and extended in the up and down direction is provided between the partition wall 27 and the frame 14. A through hole 29 communicating with the filter chamber 34 through the communication port 24*a* and an area 31 is placed in an upper part of the communication passage 28.

The through hole 29 is formed by a partition wall (annular wall) 30 continuous to the partition wall 27.

The area 31 is formed by the partition walls 22, 24, and 30 and a partition wall 30*a* (shown in FIG. 6). The area 31 is formed deep at one end part of the container main body 2 (portion communicating with the through hole 29) and shallow at an opposite end part (portion communicating with the filter chamber 34).

The differential pressure regulating valve storage chamber 33 stores the membrane valve 52 as a differential pressure regulating valve that can become elastically deformed, such as an elastomer, as shown in FIG. 7. The membrane valve 52 has a through hole 52*c*, and is urged to the filter chamber side by a helical compression spring 50, and has an outer peripheral margin fixed through an annular thick part 52*a* to the container main body 2 by ultrasonic welding. The helical compression spring 50 is supported at one end part by a spring bracket 52*b* of the membrane valve 52 and at an opposite end part by a spring bracket 203 in the differential pressure regulating valve storage chamber 33. The position accuracy of the helical compression spring 50 to the membrane valve 52 is an important element for the differential pressure regulating valve to control the differential pressure, and the convex part of the membrane valve 52 needs to be placed by the helical compression spring 50 without bend, position shift, etc., as shown in FIG. 7.

Numeral 54 denotes a frame formed integrally with the thick part 52*a* of the membrane valve 52.

The filter 55 for allowing ink to pass through and capturing dust, etc., is placed in the filter chamber 34, as shown in FIG. 7. The opening of the filter chamber 34 is sealed with the inner film 56 and the opening of the differential pressure regulating valve storage chamber 33 is sealed with the outer film 57. When the pressure in the ink supply port 4 lowers, the membrane valve 52 is separated from a valve seat part 25*b* against the urging force of the helical compression spring 50 (the through hole 52*c* is opened). Thus, ink passed through the filter 55 passes through the through hole 52*c* and flows into the ink supply port 4 through the flow passage formed by the recess part 35. When the ink pressure in the ink supply port 4 rises to a predetermined value, the membrane valve 52 sits on the valve seat part 25*b* by the urging force of the helical compression spring 50, shutting off the flow of ink. Such operation is repeated, whereby ink is supplied to the ink supply port 4 while a constant negative pressure is maintained.

[Air Flow Passage System]

As shown in FIG. 6, the container main body 2 is formed on the rear with a meander groove 36 for raising flow passage resistance, and a wide concave groove 37 (hatched portion) opened to the atmosphere, and further a recess part 38 (space part) having an almost rectangular shape in a plane view leading to the first ink storage chamber 11 (shown in FIG. 5). The recess part 38 contains a frame 39 and ribs 40, onto which an air permeable film 84 is stretched and fixed to thereby form an atmospheric ventilation chamber. A through hole 41 is made in the bottom part (wall part) of the recess part 38 and is made to communicate with an elongated area 43 defined by the partition wall 42 (shown in FIG. 5) of the second ink storage chamber 16. The area 43 has a through hole 44 and is made to communicate with the atmospheric open chamber 501 (shown in FIG. 8) through a communication groove 45 defined by a partition wall 603 and a through hole 46 opened to the communication groove 45. The opening of the atmospheric open chamber 501 is sealed with the inner film (air shield film) 502 shown in FIG. 1.

According to the configuration, when the ink cartridge 1 is mounted to the cartridge holder 71 as shown in FIG. 9, the valve operation rod 70 of the cartridge holder 71 abuts the operation arm 66 shown in FIG. 8 for moving the convex part 66*b* (pressurization film 61) to the valve body side. Accordingly, the valve body 65 is separated from the opening peripheral margin of the through hole 60 against the elastic urging force of the elastic member 62, while being guided by the convex part 64, and the first ink storage chamber 11 shown in FIG. 5 is opened to the recess part 38 (atmosphere) shown in FIG. 6 through the through holes 67, 60, and 46, the groove 45, the through hole 44, the area 43, the through hole 41, etc. The valve body 201 in the ink supply port 4 is opened by insertion of the ink supply needles 72.

As the valve body 201 in the ink supply port 4 is opened and ink is consumed by the record head 112, the pressure of the ink supply port 4 falls below a stipulated value. Thus, the membrane valve 52 in the differential pressure regulating valve storage chamber 33 shown in FIG. 7 is opened (if the pressure of the ink supply port 4 rises above the stipulated value, the membrane valve 52 is closed), ink in the differential pressure regulating valve storage chamber 33 flows into the record head 112 through the ink supply port 4.

Further, as consumption of ink in the record head 112 proceeds, ink in the first ink storage chamber 11 flows into the second ink storage chamber 16 through the communication flow passage 18 shown in FIG. 4.

On the other hand, as ink is consumed, air flows in through the through hole 67 (shown in FIG. 5) communicating with the atmosphere, and the ink liquid level in the first ink storage chamber 11 lowers. As ink is further consumed and the ink liquid level reaches the communication port 19*a*, ink from the first ink storage chamber 11 (opened to the atmosphere through the through hole 67 at the ink supplying time) flows into the second ink storage chamber 16 via the communication flow passage 18 together with air. Since bubbles are moved up by a buoyant force, only the ink flows into the third ink storage chamber 17 through the communication port 15*a* in the lower part of the vertical wall 15, passes through the communication port 26*a* of the partition wall 26 from the third ink storage chamber 17, moves up on the communication passage 28, and flows into the upper part of the filter chamber 34 from the communication passage 28 through the area 31 and the communication port 24*a*.

After this, the ink in the filter chamber 34 passes through the filter 55 shown in FIG. 7, flows into the differential pressure regulating valve storage chamber 33 from the through holes 25*a*, further passes through the through hole 52*c* of the membrane valve 52 separated from the valve seat part 25*b* and then moves down in the recess part 35 shown in FIG. 6 and flows into the ink supply port 4.

The ink is thus supplied from the ink cartridge 1 to the record head 112.

If a different kind of ink cartridge 1 is placed in the cartridge holder 71, before the ink supply port 4 arrives at the ink supply needle 72, the identification convex part 68 (shown in FIG. 7) abuts the identification piece 73 (shown in FIG. 9) of the cartridge holder 71, blocking entry of the valve operation rod 70. Therefore, occurrence of trouble as a different kind of ink cartridge is placed can be prevented. In this state, the valve operation rod 70 does not arrive at the operation arm 66 either and thus the valve body 65 is maintained in the closed valve state, preventing evaporation of the ink solvent in the first ink storage chamber 11 as it is left standing.

On the other hand, if the ink cartridge 1 is drawn out from the placement position in the cartridge holder 71, the operation arm 66 is elastically restored because it is no longer supported by the operation rod 70, and the valve body 65 is elastically restored accordingly, blocking the through hole 60, so that communication between the recess part 38 and the first ink storage chamber 11 is shut off.

Next, an assembling method of the atmospheric open valve in the ink cartridge according to the embodiment will be discussed with reference to FIGS. 10(*a*) and 10(*b*).

To begin with, as shown in FIGS. 10(*a*) and 10(*b*), the cylinder part 65*a* is inserted in the through hole 60, and the valve part 65*b* is brought into contact with the opening peripheral margin of the through hole 60, whereby the valve body 65 is disposed within the atmospheric open chamber 501.

Next, the projection 63 is inserted into the notch 62*a* of the elastic member 62, and the projection 64 is inserted into the through hole 62*b*, so that the elastic member 62 in the bent form like "<" is held on the chamber wall 8*a* of the valve storage chamber 8 (atmospheric open chamber 501) and the valve body 65, as indicated by the two-dotted chain line in FIGS. 10(*a*) and 10(*b*).

Depressing pressure P is given to the bend part 62*c* of the elastic member 62 indicated by the two-dotted lines in FIG. 10(*b*) to develop the elastic member 62 into the plane state (so as to be made horizontal) while pressing the valve body 65 in the closed direction as shown by the solid line in FIG. 10(*b*). Under the positioning or the elastic member 62 to the projections 63 and 64 in this fashion, a part of the projection 63 is crushed at room temperature to fix the elastic member 62 within the atmospheric open chamber 501. At this time, if the projection 63 is crushed, while the crest of the bend part 62*c* is depressed and held, a large elastic force from the elastic member 62 acts on the atmospheric open valve 601, and the force sealing the through hole 60 by the atmospheric open valve 601 can be increased.

Preferably, the depressing pressure onto the crest of the bend part 62*c* is set to be a predetermined depressing pressure (100 g or more) and the crest of the bend part 62*c* is depressed until the elastic member 62 is made horizontal. In the description made above, the crest of the bend part 62*c* is depressed, but the proximity of the crest of the bend part 62*c* (predetermined range) may be depressed.

According to this method, when the atmospheric open valve 601 is assembled, the force urging the valve body 65 by the elastic member 62 is determined.

Therefore, in the embodiment, the need for considering the fixing position of the elastic member, etc., at the design time as in the related art is eliminated, so that the number of design items can be decreased and an ink cartridge 1 easily designed can be obtained.

In the embodiment, in fixing the elastic member 62, the projection 63 is inserted into the notch 62*a* and a part of the insertion end part is crushed at room temperature. Accordingly, the elastic member 62 can be prevented from becoming deformed.

In addition, as shown, for example, in FIG. 10(*b*), the valve body 65 preferably has a sealing part 65*c* that defines a sealing surface of the valve part 65*b* opposing the through hole 60 and that is made of relatively soft material (elastic material) such as an elastomer.

As seen in the description made above, according to the ink cartridge and the assembling method of the atmospheric open valve in the ink cartridge according to the invention, the number of design items can be decreased and therefore the ink cartridge design can be simplified.

What is claimed is:

1. An ink cartridge detachably mounted on a recording apparatus, the ink cartridge comprising:

a cartridge main body having an atmospheric communication hole for communicating an ink storage chamber and an atmospheric open chamber with each other; and an atmospheric open valve having a valve body capable of opening and closing the atmospheric communication hole of said cartridge main body, and a plate spring disposed on the cartridge main body, and capable of pressing the valve body in a closed direction, wherein:

the plate spring presses, at one end part, the valve body in the closed direction, and is fixed, at an opposite end part.

2. The ink cartridge according to claim 1, wherein the plate spring is made of a bent piece.

3. The ink cartridge according to claim 1, wherein the valve body includes a valve part contacting the one end part of the plate spring and selectively opening and closing the atmospheric open valve, and a projecting part extending from the valve part and being movable inserted into the atmospheric communication hole.

4. The ink cartridge according to claim 3, wherein the valve part further includes a sealing part that defines a sealing surface of the valve part opposing the atmospheric communication hole that is made of relatively soft material.

5. The ink cartridge of claim 4, wherein the sealing part of the valve part is made of an elastic material.

6. The ink cartridge of claim 1, wherein the plate spring extends in a direction in which the ink cartridge is attached to the recording apparatus.

7. The ink cartridge of claim 1, wherein an intermediary part of the plate spring, between the one end part and opposite end part, is fixed to the inside of the atmospheric open chamber.

8. The ink cartridge of claim 7, wherein the plate spring at the one end part has a notch, and at he intermediary part has a through hole, wherein the notch is fixed to a first projection inside of the atmospheric chamber and the through hole is fixed to a second protection inside of the atmospheric chamber.

9. The ink cartridge of claim 8, wherein the first projection and the second projection extend in a direction parallel to an axial direction of the atmospheric communication hole.

10. The ink cartridge of claim 9, wherein a movement of the one end part of the plate spring is guided by the intermediary part of the plate spring fixed to the second protection.

11. The ink cartridge of claim 1, further comprising:

a movable arm member that presses the valve body in an open direction.

12. The ink cartridge of claim 11, wherein the movable arm member and the plate spring are substantially parallel to each other.

13. The ink cartridge of claim 11, wherein the movable arm presses the valve body in the open direction in conjunction with an attaching of the ink cartridge to a recording apparatus.

14. The ink cartridge of claim 13, further comprising a valve storage chamber adapted to receive an operation rod of the recording apparatus, wherein the movable arm presses the valve body in the open direction, in response to the operation rod, when attaching the ink cartridge to the recording apparatus.

15. The ink cartridge of claim 14, wherein the operation rod abuts the movable arm, when attaching the ink cartridge to the recording apparatus.

16. The ink cartridge of claim 13, wherein if the ink cartridge is withdrawn from the recording apparatus, the movable arm is elastically restored in a position whereby the valve body closes the atmospheric communication hole.

17. The ink cartridge of claim 1, wherein the plate spring maintains the valve body in the closed state when the ink cartridge is not mounted on the recording apparatus.

18. The ink cartridge of claim 1, wherein the plate spring is disposed within an inside of the atmospheric open chamber.

19. The ink cartridge of claim 1, further comprising:

a circuit board that includes a storage device for storing data.

20. The ink cartridge of claim 1, further comprising:

an identification device for determining, before an ink supply needle on a recording apparatus communicates with an ink supply port of the ink cartridge, whether the ink cartridge is compatible with the recording apparatus.

21. The ink cartridge of claim 1, further comprising:

a member having a first end attached to the cartridge main body and a second end which presses the valve body to open the atmospheric communication hole.

22. The ink cartridge of claim 1, further comprising:

an elastically deformable film attached to the cartridge main body and defining, between the elastic deformable film and the atmospheric communication hole, a space communicating with the ink storage chamber.

23. The ink cartridge of claim 1, wherein the valve body is movable in a direction perpendicular to a direction in which the ink cartridge is mounted to the recording apparatus.

24. The ink cartridge of claim 1, wherein the plate spring presses the valve body in a direction from the atmospheric open chamber to the ink storage chamber.

25. An ink cartridge comprising:

a cartridge main body having an atmospheric communication hole for communicating an ink storage chamber and an atmospheric open chamber with each other; and an atmospheric open valve having a valve body capable of opening and closing the atmospheric communication hole of said cartridge main body, and a plate spring made of a bent piece and capable of pressing the valve body in a closed direction, wherein:

the valve body is disposed at such a position as to close an opening of the atmospheric communication hole;

the plate spring is developed to be positioned in place in the atmospheric open chamber; and in a state of positioning the plate spring in place, the plate spring presses, at a contact end part, the valve body in the closed direction, and is fixed, at an opposite end part, to an inside of the atmospheric open chamber.

26. The ink cartridge as claimed in claim 25, wherein:

a chamber wall of the atmospheric open chamber is formed with two convex parts projecting in a direction parallel to an axial direction of the atmospheric communication hole;

the convex parts are inserted into the plate spring;

movement of the contact end part of the plate spring is regulated by a first inserted end part of the first convex part close to the valve body; and a second inserted end part of the second convex part distant from the valve body is crushed under pressure to fix the opposite end part of the plate spring.

27. The ink cartridge as claimed in claim 26, wherein a crush position of the second inserted end part is positioned in order to reduce a spring effective length of the plate spring.

28. An assembling method for an ink cartridge comprising:

a cartridge main body having an atmospheric communication hole for communicating an ink storage chamber and an atmospheric open chamber with each other;

an atmospheric open valve having a valve body capable of opening and closing the atmospheric communication hole of the cartridge main body, and a plate spring made of a bent piece and capable of pressing the valve body in a closed direction, wherein a method of assembling the atmospheric open valve in the atmospheric communication hole;

applying a necessary force to the plate spring so that the valve body is pressed in the closed direction, thereby positioning the plate spring in place in the atmospheric open chamber; and fixing an end part of the plate spring, opposite from a pressing end part of the plate spring, onto an inside of the atmospheric open chamber.

29. The assembling method of the atmospheric open valve as claimed in claim 28, wherein in fixing the end part of the plate spring, a convex part is formed on a chamber wall defining the atmospheric open chamber and is inserted into the end part of the plate spring, wherein the convex part is partially crushed under pressure of air at room temperature.

30. The assembling method of the atmospheric open valve as claimed in claim 28 or 29, wherein a crest of a bent part of the plate spring or a proximity thereof is depressed by the necessary force.

31. The assembling method of the atmospheric open valve as claimed in claim 30, further comprises the step of:

measuring the necessary force applied to the crest of the bent part or the proximity thereof.

32. The assembling method of the atmospheric open valve as claimed in claim 30 or 31, wherein the crest of the bent part or the proximity thereof is depressed so that the plate spring is made horizontal.

33. An ink cartridge comprising:

a cartridge main body having an atmospheric communication hole for communicating an ink storage chamber and an atmospheric open chamber with each other;

an atmospheric open valve having a valve body capable of opening and closing the atmospheric communication hole of said cartridge main body;

a member having a first end attached to the cartridge main body and a second end which presses the valve body to open the atmospheric communication hole; and an elastic member capable of pressing the valve body in a closed direction, wherein the elastic member presses, at one end part, the valve body in the closed direction, and is fixed, at an opposite end part.

34. The ink cartridge of claim 33, wherein the elastic member is disposed within an inside of the atmospheric open chamber.

35. The ink cartridge of claim 33, further comprising:

an elastically deformable film attached to the cartridge main body and defining, between the elastic deformable film and the atmospheric communication hole, a space communicating with the ink storage chamber.

36. The ink cartridge of claim 33, wherein the valve body is movable in a direction perpendicular to a direction in which the ink cartridge is mounted to a recording apparatus.

37. The ink cartridge of claim 33, wherein the elastic member presses the valve body in a direction from the atmospheric open chamber to the ink storage chamber.

38. An ink cartridge comprising:

a cartridge main body having an atmospheric communication hole for communicating an ink storage chamber and an atmospheric open chamber with each other;

an atmospheric open valve having a valve body capable of opening and closing the atmospheric communication hole of said cartridge main body;

an elastically deformable film attached to the cartridge main body and defining, between the elastic deformable film and the atmospheric communication hole, a space communicating with the ink storage chamber; and an elastic member capable of pressing the valve body in a closed direction, wherein the elastic member presses, at one end part, the valve body in the closed direction, and is fixed, at an opposite end part.

39. The ink cartridge of claim 38, wherein the elastic member is disposed within an inside of the atmospheric open chamber.

40. The ink cartridge of claim 38, wherein the valve body is movable in a direction perpendicular to a direction in which the ink cartridge is mounted to a recording apparatus.

41. The ink cartridge of claim 38, wherein the elastic member presses the valve body in a direction from the atmospheric open chamber to the ink storage chamber.

42. An ink cartridge comprising:

a cartridge main body having an atmospheric communication hole for communicating an ink storage chamber and an atmospheric open chamber with each other;

an atmospheric open valve having a valve body capable of opening and closing the atmospheric communication hole of said cartridge main body, wherein the valve body is movable in a direction perpendicular to a direction in which the ink cartridge is mounted to a recording apparatus; and an elastic member capable of pressing the valve body in a closed direction, wherein the elastic member presses, at one end part, the valve body in the closed direction, and is fixed, at an opposite end part.

43. The ink cartridge of claim 42, wherein the elastic member is disposed within an inside of the atmospheric open chamber.

44. The ink cartridge of claim 42, wherein the elastic member presses the valve body in a direction from the atmospheric open chamber to the ink storage chamber.

45. An ink cartridge comprising:

a cartridge main body having an atmospheric communication hole for communicating an ink storage chamber and atmospheric open chamber each other;

an atmospheric open valve having a valve body capable of opening and closing the atmospheric communication hole of said cartridge main body; and an elastic member capable of pressing the valve body in a closed direction, wherein the elastic member presses, at one end part, the valve body in the closed direction, and is fixed, at an opposite end part, and wherein the elastic member presses the valve body in a direction from the atmospheric open chamber to the ink storage chamber.

46. The ink cartridge of claim 45, wherein the elastic member is disposed within an inside of the atmospheric chamber.

47. An ink cartridge comprising:

a valve member that opens and closes an atmospheric communication hole;

an elastic member that presses the valve member in a closed direction wherein an intermediary portion of the elastic member, between a first end portion and a second end portion of the elastic member, is connected to a main body of the ink cartridge.

48. The ink cartridge of claim 47, wherein the elastic member presses the valve body in a direction from an atmospheric open chamber to an ink storage chamber.

49. The ink cartridge of claim 48, wherein the elastic member is disposed within the atmospheric open chamber.

50. The ink cartridge of claim 49, wherein a first end portion of the elastic member presses the valve member in the closed direction and a second end portion of the elastic member is connected to the main body of the ink cartridge.

51. The ink cartridge of claim 47, wherein a movable arm presses the valve member in an open direction in conjunction with an attaching of the ink cartridge to a recording apparatus.

52. The ink cartridge of claim 47, wherein the movable arm member and the elastic member are substantially parallel to each other.

53. The ink cartridge of claim 47, wherein the elastic member is made of a bent piece that bends to a substantially flat piece when closing the valve member.

54. The ink cartridge of claim 47, wherein the valve member is movable in a direction perpendicular to a direction in which the ink cartridge is mounted to a recording apparatus.

55. The ink cartridge of claim 47, wherein the atmospheric communication hole providing communication between an ink storage chamber and an open chamber.

56. The ink cartridge of claim 47, further comprising:

a film attached to the main body of the ink cartridge and defining, between the film and the atmospheric communication hole, a space.

57. The ink cartridge of claim 56, wherein the space communicates with an ink storage chamber.

58. The ink cartridge of claim 47, wherein the valve member is movable in a direction perpendicular in which the ink cartridge is mounted to a recording apparatus.

59. A printing system comprising:

a printer; and a cartridge comprising:

a valve member that opens and closes a communication hole, the communication hole providing communication between a storage chamber and an atmospheric open chamber;

an elastic member that presses the valve member in a closed direction; and a movable arm member that presses the valve member in an open direction.

60. An assembling method for an ink cartridge comprising:

a valve member that opens and closes a communication hole, the communication hole providing communication between an ink storage chamber and an atmospheric chamber;

an elastic member that presses the valve member in a closed direction; and a movable arm member that presses the valve member in an open direction, wherein a method of assembling the valve member in the atmospheric chamber comprises the steps of:

positioning the valve member in a position close to the communication hole;

determining a necessary force to be directed to a portion of the elastic member so that a first end portion of the elastic member presses the valve member in the closed direction; and attaching the elastic member within the atmospheric chamber.

61. The assembling method of the valve member in the atmospheric chamber of claim 60, the attaching further comprises the steps of:

wherein the elastic member comprising a notch at a second end portion of the elastic member;

inserting the notch of the elastic member into a first wall defining the atmospheric chamber;

crushing the first wall to fix the second end portion of the elastic member, wherein said crushing is caused by exposure to air at room temperature.

62. The assembling method of the valve member in the atmospheric chamber of claim 60, the determining further comprises the steps of:

wherein the elastic member is made of a bent piece;

exposing a predetermined force to a crest part of the bent part or a proximity thereof until the elastic member is made flat.

63. An ink cartridge, comprising:

a first though hole that at least indirectly connects a first chamber to a second chamber, wherein the first chamber stores ink;

a valve that selectively opens and seals the first through hole; and an operation member that is pressed by a protruding member of an ink jet recording apparatus, such that the operational member opens the valve, wherein the first through hole is at least indirectly coupled an atmosphere, wherein, when the ink flows from the first chamber and through the first through hole, the ink accumulates in the second chamber, and wherein the valve opens the first through hole by moving in a direction that is different that a direction that the protruding member travels when pressing the operation member.

64. The ink cartridge as claimed in claim 63, wherein the valve comprises:

a first part that is contained in the first through hole; and a second part that selectively abuts against a peripheral opening of the first through hole to selectively seal the first through hole.

65. The ink cartridge as claimed in claim 64, wherein the first part of the valve is cylindrically-shaped.

66. The ink cartridge as claimed in claim 64, wherein the first part of the valve extends completely through the first through hole when the valve seals the first through hole.

67. The ink cartridge as claimed in claim 64, further comprising:

a third chamber fluidly connected between the first chamber and the second chamber, wherein the second part of the valve is disposed within the second chamber.

68. The ink cartridge as claimed in claim 67, further comprising a second through hole that at least indirectly connects the third chamber to the first chamber.

69. The ink cartridge as claimed in claim 68, wherein the first through hole and the second through hole at least indirectly connect the first chamber to the atmosphere.

70. The ink cartridge as claimed in claim 64, further comprising as elastic member that abuts against the second part of the valve to urge the second part of the valve towards the peripheral opening of the first through hole.

71. The ink cartridge as claimed in claim 70, wherein the elastic member is a spring.

72. The ink cartridge as claimed in claim 63, wherein the second chamber is at least partially defined by a deformable film.

73. The ink cartridge as claimed in claim 72, wherein the link cartridge comprises a rigid main body, and wherein the second chamber is at least partially defined by the rigid main body.

74. The ink cartridge as claimed in claim 63, wherein the first through hole is disposed above a floor of the second chamber when the ink cartridge is installed in a printer.

75. An ink cartridge, comprising:

an ink chamber that stores ink;

an ink supply port from which the ink stored in the ink chamber can flow out;

a through hole connecting a first chamber and a second chamber;

a valve that is biased to normally seal the through hole; and a deformable film, wherein, when the deformable film is deformed, the valve is moved to open the through hole so that an atmosphere communication passage is formed from the ink chamber to an atmosphere via the first and the second chambers without going through the ink supply port.

76. The ink cartridge as claimed in claim 75, wherein the valve comprises:

a first part that extends from the first chamber, through the through hole, and into the second chamber; and a second part that is disposed in the first chamber and that abuts against an opening periphery of the through hole to seal the through hole.

77. The ink cartridge as claimed in claim 76, wherein, when the deformable film is deformed, the film urges the first part of the valve in a direction from the second chamber to the first chamber such that the second part of the valve is separated from the opening periphery of the hole to open the through hole.

78. The ink cartridge as claimed in claim 75, wherein the deformable film is acted on by a force that is transferred to the valve so that the valve is moved to open the through hole.

79. An ink cartridge, comprising:

a through hole connecting a first chamber and a second chamber;

a valve that is biased to normally seal the through hole; and a deformable film, wherein, when the deformable film is deformed, the valve is moved to open the through hole, wherein the valve comprises a first part that extends into the through hole, and wherein, when the deformable film is deformed, the first part is urged in a direction such that the valve opens the through hole.

80. The ink cartridge as claimed in claim 79, wherein the deformable film is acted on by a force that is transferred to the valve so that the valve is moved to open the through hole.

81. An ink cartridge comprising:

a valve member that opens and closes a communication hole, the communication hole providing communication between a storage chamber and an atmospheric open chamber;

an elastic member that presses the valve member in a closed direction; and an operation member that presses the valve member in an open direction, wherein when the operation member is pressed by a protruding member of an ink jet recording apparatus, the valve member opens the communication hole against pressing force of the elastic member, and wherein the valve member opens the first through hole by moving in a direction that is different than a direction that the protruding member travels when pressing the operation member.

82. The ink cartridge as claimed in claim 81, wherein the operation member includes a movable arm member.

* * * * *